US007989039B2

(12) United States Patent
Chung

(10) Patent No.: US 7,989,039 B2
(45) Date of Patent: Aug. 2, 2011

(54) CONNECTING MATERIAL FOR COLD TRANSFER PRINTING PAPER AND PREPARATION

(75) Inventor: Po Wen Chung, Huacao Town (CN)

(73) Assignee: Shanghai Newtech Fabric Printing Co., Ltd., Shanghai (CN)

( * ) Notice: Subject to any disclaimer, the term of this patent is extended or adjusted under 35 U.S.C. 154(b) by 1076 days.

(21) Appl. No.: 11/766,390

(22) Filed: Jun. 21, 2007

(65) Prior Publication Data

US 2008/0280758 A1 Nov. 13, 2008

(30) Foreign Application Priority Data

May 9, 2007 (CN) ..... 2007 1 0040431

(51) Int. Cl.
*B41M 5/50* (2006.01)

(52) U.S. Cl. ..... 428/32.51; 427/152

(58) Field of Classification Search ..... None
See application file for complete search history.

(56) References Cited

U.S. PATENT DOCUMENTS

| | | | | |
|---|---|---|---|---|
| 5,318,943 | A * | 6/1994 | Ueno et al. | 503/227 |
| 6,858,255 | B2 | 2/2005 | Deckers et al. | |

FOREIGN PATENT DOCUMENTS

| | | |
|---|---|---|
| JP | 50-53687 | 5/1975 |
| SU | 937168 | 6/1982 |
| SU | 1 018 409 A1 | 8/1995 |

* cited by examiner

*Primary Examiner* — Bruce H Hess
(74) *Attorney, Agent, or Firm* — Dinsmore & Shohl LLP

(57) ABSTRACT

A connecting material for cold transfer printing paper is provided and includes an acrylic coating agent composition as an isolating layer and an acrylic coating agent composition as an ink-receiving layer. Also provided is a method for preparing the connecting material for cold transfer printing paper, a cold transfer printing paper and a method for printing a pattern or letter on a fabric by using the cold transfer printing paper.

15 Claims, No Drawings

CONNECTING MATERIAL FOR COLD TRANSFER PRINTING PAPER AND PREPARATION

TECHNICAL FIELD

The present invention relates to a connecting material for cold transfer printing paper in printing and dyeing industry and preparation method thereof. Specifically, the present invention relates to a connecting material for cold transfer printing paper comprising an acrylic coating agent composition as an isolating layer and an acrylic coating agent composition as an ink-receiving layer, and to a method for preparing the connecting material, as well as a cold transfer printing paper and a method for printing a pattern or letter on a fabric using the cold transfer printing paper.

BACKGROUND ART

Nowadays, transfer printing method has become a new technology for daily-use industrial decoration and printing process of fabric. This technology generally includes the following steps: firstly, printing the desired a pattern or letter on a base paper by printing using a proper printing ink to produce a transfer printing paper; then, pressing the surface with the printing ink of the transfer printing paper to a blank fabric; and removing and peeling the printing ink from the transfer printing paper under the action of pressure and wetting, thereby transferring the a pattern or letter from the transfer printing paper to the fabric. Usually, the transfer printing method may be classified into thermal transfer printing method (i.e., hot-melt pressure sensitive transfer printing by heating) and cold transfer printing method (transfer printing at environmental temperature after padding with a pretreatment agent, no heat is needed).

Patent SU937468A1 in 1982 discloses a thickener for fabric printing, and patent SU1018409A1 in 1995 discloses a method for preparing an emulsion from methacrylic acid and butyl acrylate under the initiation of DMF in a solvent. The thickener and the resulting emulsion in the above two patents are different from the present invention not only in their preparation method, but also mainly in that they don't have the hydrotropic rate and peeling rate necessary for transfer printing, and thus can only be used as ordinary printing paste.

Patent JP50053687A in 1975 and patent U.S. Pat. No. 6,858,255B2 in 2005 also respectively relate to a printing paste, which is only used for fibril sizing and coat printing. Since the pastes don't have the technical standard necessary for transfer printing too, the catalyst system, solvent and additive used in the polymerization are different from those in the present invention, and the preparation steps are completely different from those in the present invention.

The most difficulty in transfer printing is that the printing ink can't be totally transferred from the printing paper to the fabric, a large amount of dyes remain on the printing paper, which causes a number of problems, including, for example, on one hand, the waste of a large amount of dyes, environmental pollution, and low regeneration rate of wastepaper, and on the other hand, low dye yield in transfer printing and poor color fastness of the printed fabric. Moreover, conventional transfer printing paper and transfer printing process thereof can be only used for chemical fabrics, especially polyester fabrics, but is not useful for natural fibers such as cotton, wool, silk and cellulose fiber etc., the reason is that natural fibers usually use water-soluble dyes, for example, reactive dyes or weak acidic dyes (cf. Dyeing & Finishing, 1999, No. 3, Wet Transfer Printing of Pure Cotton Fabric with Reactive Dyes), this water-soluble dyes will bond to paper so that it is difficult to transfer the a pattern or letter from the printing paper to the fabric, with a transfer rate of about 60% only. Therefore, there needs a connecting material between base paper and printing ink in a transfer printing paper, which can serve as not only an ink-receiving layer in printing but also an isolating layer in transfer printing, that is, the connecting material can make printing ink stay on the paper well and thus keep a high pattern sharpness, and at the same time can easily transfer the a pattern or letter printed with printing ink from the printing paper to the fabric, with a transfer rate of above 90%, as a result, the environmental pollution caused by ink residue is decreased, and the regeneration and utilization of wastepaper is increased.

CONTENTS OF THE INVENTION

In order to solve the problems that the ordinary transfer printing paper can't be used for fabrics made of natural fibers such as cotton and wool etc. and to overcome the drawbacks of cold transfer printing paper coated with only one ink-receiving layer or one transfer type isolating layer connecting material in the production and transfer printing of the transfer printing paper, the present invention provides a connecting material for cold transfer printing paper. The cold transfer printing paper coated with the connecting material of the present invention has many obvious advantages, including increased quality of a printed pattern and high transfer rate, and it can be used for fabrics made of natural fibers such as cellulose fiber, for example modified cellulose fiber and cotton, and protein fiber, for example wool and silk etc., and for chemical fabrics, and the operation is simple and convenient.

Thus, the present invention provides a connecting material for cold transfer printing paper, comprising an acrylic coating agent composition as an isolating layer and an acrylic coating agent composition as an ink-receiving layer, wherein the acrylic coating agent composition as an isolating layer comprises an acrylic resin, a solvent, a toughening agent and a filler; and the acrylic coating agent composition as an ink-receiving layer comprises an acrylic monomer, a modified starch, an emulsifier, a non-emulsifying surfactant, a wetting agent, an initiator, a crosslinking agent and a copolymerization terminator.

The above compositions are described in detail in the following paragraphs.

Acrylic Coating Agent Composition as an Isolating Layer

The acrylic coating agent composition as an isolating layer comprises acrylic resin, solvent, toughening agent and filler.

The acrylic resin useful for the present invention is a polymer of C1-C10 alkyl (meth)acrylate. The preferred example includes a copolymer of methyl methacrylate (MMA) and n-butyl methacrylate (BMA), wherein the weight ratio of the comonomers is from 5:5 to 4:6. The above monomer materials are available commercially, then are polymerized according to the conventional polymerization method in the art, thereby obtaining the polymer useful for the preset invention.

The solvent useful for the present invention comprises those commonly used in the art, including ketones, such as acetone and methyl isobutyl ketone etc.; esters, such as ethyl acetate and butyl acetate etc.; aromatic compounds, such as benzene and toluene etc.; amides, such as dimethylformamide etc. The solvent may be used alone or in a combination of two or more ones. The solvent is preferably a mixture of ethyl acetate and dimethylformamide in a weight ratio of from about 2:8 to 5:5, more preferably a mixture of ethyl acetate and dimethylformamide in a weight ratio of about 3:7.

The toughening agent useful for the present invention includes those commonly used in the art, for example, epoxy fatty acid dibutyl esters, dibutyl phthalate (DBP) and dioctyl phthalate (DOP) etc., preferably dioctyl phthalate (DOP).

The filler useful for the present invention includes those commonly used in the art, for example, light calcium carbonate, paligorskite and fumed silica etc., preferably fumed silica.

The acrylic coating agent composition as an isolating layer according to the present invention may further comprise conventional additives used in coating agent composition, for example, viscosity adjuster, antifoaming agent, colorant (to effectively test the coating evenness on the surface of the base paper of transfer printing paper), mildew inhibitor and lubricant etc. The total weight of the above additives in the composition is usually not more than 2% by weight.

The above acrylic coating agent composition as an isolating layer, based on the total weight of the composition, comprises: 20-30%, preferably 25-26%, of an acrylic resin; 60-77%, preferably 62-70%, of a solvent, for example, 22-20% of ethyl acetate and 40-50% of dimethylformamide, preferably 20% of ethyl acetate and 50% of dimethylformamide; 2-8%, preferably 3-5%, of a toughening agent; and 0.2-2%, preferably 0.5%, of a filler.

In one preferred embodiment, the acrylic coating agent composition as an isolating layer, based on the total weight of the composition, comprises: 25% of a copolymer of methyl (meth)acrylate and n-butyl methacrylate (the weight ratio of comonomers is 4:6); 20% of ethyl acetate and 50% of dimethylformamide; 4.5% of dioctyl phthalate; and 0.5% of fumed silica.

Acrylic Coating Agent Composition as an Ink-Receiving Layer

The acrylic coating agent composition as an ink-receiving layer comprises an acrylic monomer, a modified starch, an emulsifier, a non-emulsifying surfactant, a wetting agent, an initiator, a crosslinking agent and a copolymerization terminator.

The acrylic monomer useful for the present invention includes acrylic acid and C1-C4 alkyl acrylates, such as butyl acrylate, ethyl acrylate and isopropyl acrylate etc. Acrylic acid and butyl acrylate monomer in a weight ratio of from 1:1 to 1:2.5 are preferred. The above acrylic monomers are available commercially, and the acrylic monomer may be used alone or in a combination of two or more ones.

The modified starch useful for the present invention includes ester group-containing modified starch, such as vinyl ester modified starch (i.e., vinyl acetate modified starch), vinyl acetate modified dextrin and so on. The preferred one is vinyl ester modified dextrin. The above vinyl ester modified starches are available commercially, for example, from Shanghai Modified Starch Factory.

The emulsifier useful for the present invention includes those commonly used in the art, for example, higher fatty alcohol sulfates, such as sodium dodecyl sulfate, sodium cetyl sulfate, sodium stearyl sulfate etc., sorbitan monooleate, laureates and monostearates etc. The preferred one is sorbitan monooleate.

The non-emulsifying surfactant useful for the present invention includes anionic surfactants and a part of nonionic surfactants commonly used in the art, including higher fatty alcohol sulfates, such as sodium dodecyl sulfate; sulfosuccinates compounds, such as sulfosuccinate 4910; fatty alcohol ethers, such as fatty alcohol polyoxyethylene ether (trade name Invadine-JFC), and the like.

The wetting agent useful for the present invention includes those commonly used in the art, for example, pyrrolidone carboxylic acid salts, such as sodium pyrrolidone carboxylate; Turkey red oil; nekal BX (sodium butyl naphthalene sulfonate); sulfonated oil DAH (sulfated compounds of esterified oil). The preferred one is sodium pyrrolidone carboxylate.

The initiator useful for the present invention includes those commonly used in the art, for example, benzoyl peroxide, potassium persulfate, sodium bisulfite redox system. The preferred one is potassium persulfate.

The crosslinking agent useful for the present invention is preferably N-hydroxymethyl acrylamide (a water-soluble crosslinking monomer). Due to the presence of vinyl group having polymerization performance and hydroxymethyl group having condensation performance in the composition, a cross-linking reaction can occur only by heating when they copolymerizes with the acrylic monomer.

The copolymerization terminator (inhibitor) useful for the present invention includes those commonly used in the art, for example, hydroquinone, sodium sulfite and so on. The preferred one is sodium sulfite.

The acrylic coating agent composition as an ink-receiving layer according to the present invention may further comprise conventional additives used in coating agent composition, for example, a pH adjuster (such as trisodium phosphate, ammonia, sodium dihydrogen phosphate etc.) and defoamer. The total amount of these additives in the composition is about 0.5-1% by weight.

The above acrylic coating agent composition as an ink-receiving layer, based on the total weight of the composition, comprises: 15-30%, preferably 18-25%, of an acrylic monomer; 15-23%, preferably 18-20%, of a modified starch; 5-8% of an emulsifier; 0.5-1.2% of a wetting agent; 0.3-0.6% of a non-emulsifying surfactant; 0.4-0.9% of an initiator; 0.001-0.01% of a crosslinking agent; 0.12-0.15% of a terminator, and water balanced to 100%.

In one preferred embodiment, the acrylic coating agent composition as an ink-receiving layer, based on the total weight of the composition, comprises: 7% of acrylic acid monomer and 14.5% of butyl acrylate monomer; 18.6% of vinyl ester modified dextrin; 6% of sorbitan monooleate; 1% of sodium pyrrolidone carboxylate; 0.5% of sulfosuccinate 4910; 0.5% of potassium persulfate; 0.001% of N-hydroxymethyl acrylamide; 0.15% of sodium sulfite; and distilled water balanced to 100%.

The present invention also relates to a method for preparing the above connecting material for cold transfer printing paper, comprising:

(1) preparing an acrylic coating agent composition as an isolating layer by the steps of:

(11) providing an acrylic resin and a solvent, and mixing them to obtain a transparent mixture, and

(12) adding a toughening agent and a filler to the mixture obtained in step (11), and mixing them until uniform, thereby obtaining an acrylic coating agent composition as an isolating layer; and (2) preparing an acrylic coating agent composition as an ink-receiving layer by the steps of:

(21) providing water and a modified starch, and allowing the modified starch to dissolve and maturate under heating and stirring conditions,

(22) adding an emulsifier to the mixture obtained in step (21) at a temperature of 35-40° C., to make an emulsion,

(23) at a temperature of 50-60° C., adding to the emulsion obtained in step (22) an acrylic monomer, a wetting agent and a non-emulsifying surfactant in turn, followed by mixing them under stirring until uniform,

(24) adding an initiator and a crosslinking agent at a temperature of 55-60° C. to initiate graft copolymerization reaction,

(25) adding a copolymerization terminator under stirring when the system temperature reaches 65-70° C., and

(26) according to GB/T1723-93 method, measuring viscosity of the resulting product using a Zahn 3# cup, and when the flow rate being 50-58 seconds, immediately cooling down the system to room temperature with refluxing water, thereby obtaining an acrylic coating agent composition as an ink-receiving layer.

Specifically, the above method for preparing the connecting material for cold transfer printing paper comprises:

(11) feeding an acrylic resin and a solvent to a closed mixer, and mixing them under stirring at a rate of 300-500 r/min to obtain a transparent mixture (about 3 hours), and (12) adding a toughening agent and a filler to the mixture, and mixing under stirring until uniform (about 30-45 min), thereby obtaining an acrylic coating agent composition as an isolating layer;

(21) feeding distilled water and a modified starch to an industrial reactor, stirring them until uniform, then raising the temperature to about 65-90° C., and maintaining this temperature until the modified starch is fully dissolved and maturated, (22) cooling down to 35-40° C., adding an emulsifier and continuing the reaction under stirring for about 50-90 minutes to make an emulsion, (23) raising the temperature to 50-60° C., and adding an acrylic monomer, a wetting agent and a non-emulsifying surfactant in turn, and stirring them until uniform, (24) while maintaining the system temperature at 55-60° C., adding an initiator and a crosslinking agent under stirring, at this moment, the system temperature will automatically raise due to graft-copolymerization reaction, (25) adding a copolymerization terminator under stirring when the temperature reaches about 65-70° C., (26) measuring the flow rate using a Zahn 3# cup, and when the flow rate being 50-58 seconds, immediately cooling down the system with refluxing water, so that the graft-copolymerization reaction is terminated when cooling down to room temperature, and (27) adjusting the pH of the system with a pH adjuster to pH=7-9, thereby obtaining an acrylic coating agent composition as an ink-receiving layer.

The connecting material for cold transfer printing paper according to the present invention comprises an acrylic coating agent composition as an isolating layer and an acrylic coating agent composition as an ink-receiving layer respectively. The acrylic coating agent composition as an isolating layer is applied on a base paper to obtain an isolating layer, which can effectively isolate ink from penetrating into the base paper, thereby improving the transfer rate of ink. The acrylic coating agent composition as an ink-receiving layer is applied on the above isolating layer to obtain an ink-receiving layer, which has appropriate hydrophilicity and can effectively receive printing ink, thereby ensuring the integrity of a printed pattern, as a result, on one hand, a complete and clear printed pattern is obtained, and the dye pattern is well attached without dyes loss, and on the other hand, the ink-receiving layer can fully dissolved when being transferred to the fabric, which improves the efficiency of transfer printing.

In the present invention, the above acrylic coating agent composition as an ink-receiving layer can also be used for a transfer printing paste. Said transfer printing paste comprises 45-50% by weight of the above acrylic coating agent composition as an ink-receiving layer, 20-40% by weight of dyes, 0-10% by weight of filler (for example, palygorskite), 1-5% by weight of Turkey red oil (for example, PRINTOL S-c from Henkel Company), a pH adjuster to adjust pH to be neutral, and water balanced to 100% by weight.

The transfer printing paste should meet the following standards: (1) ink should have good water solubility, and the dissolution rate is within five seconds from base paper to fabric, (2) the a pattern or letter formed by ink on the surface of a base paper should have good attachment fastness after drying, and (3) ink should have the characteristics of loose, soft, short, thin and smooth, to ensure an uniform printing of ink and a clear pattern without sticky dirt, and to maintain a certain color depth. The transfer printing paste according to the present invention totally meets the above standards.

There is no special restriction on the method for coating the connecting material composition of the present invention on a base paper and the method for curing the coating. Any methods and equipments known in the art may be used for the coating and curing. The coating method includes, for example, knife coating, cylinder coating, extrusion coating, roller coating etc. For the isolating layer, coating amount is typically 5-8 g/m$^2$; and for the ink-receiving layer, coating amount is typically 8-10 g/m$^2$. The curing method includes, for example, curing by heating in an oven at 35-45° C. (for the isolating layer) and curing by heating in an oven at 70-90° C. (for the ink-receiving layer). Thereafter, various printing machines such as gravure or flexographic printing machines may be used to print a pattern or letter on the ink-receiving layer of the base paper having the isolating layer and the ink-receiving layer, followed by drying it with hot air, thereby obtaining a cold transfer printing paper.

Thus, the invention also relates to a cold transfer printing paper, comprising a base paper and an isolating layer formed thereon and an ink-receiving layer formed on the isolating layer; said isolating layer and ink-receiving layer are obtained respectively by curing aforesaid acrylic coating agent composition as an isolating layer and the acrylic coating agent composition as an ink-receiving layer. The base paper may be any paper commonly used in the art, for example, writing paper, offset paper, printing paper, glazed paper, packaging paper, and roll paper with a weight of 25-125 g/m$^2$. The coating and curing of the isolating layer and the ink-receiving layer are as described above.

The invention further relates to a method for printing a pattern or letter on a fabric, comprising the use of the cold transfer printing paper as described above. The fabric includes not only the fabrics made of natural fibers such as cellulose fibers, for example modified cellulose fibers and cotton, and protein fibers, for example wool and silk, but also the fabric made of chemical fibers such as terylene, nylon, and acrylic fibers etc. The fabrics may be, for example, knitted fabrics, woven fabrics, hemp carpets, napp fabric, khaki drill, denim, silk products and non-woven fabrics etc. By using the method according to the present invention, a pattern or letter can be easily transferred from the cold transfer printing paper to the fabrics, with a transfer rate of above 90%.

In the present specification and claims, the article "a" or "an" does not mean singular form, instead, it covers plural form.

Unless stated otherwise, all amounts in the present specification are based on weight. The production processes that are not specifically described herein are carried out according to known methods in the prior art. Unless stated otherwise, temperature and pressure related herein refer to normal temperature and normal pressure.

In the present specification, the viscosity is measured in accordance with the national standards GB/T1723-93 "A Method for the Measurement of the Viscosity of Coatings" using a Zahn 3# cup.

MODE OF CARRYING OUT THE INVENTION

The present invention is further described by the following non-restrictive examples.

Example 1

An Acrylic Coating Agent Composition as an Isolating Layer and Preparation Thereof In this example, the acrylic coating agent composition as an isolating layer, based on the total weight of the composition, comprises: 25% of acrylic resin; 20% of ethyl acetate, 50% of dimethylformamide; 4.5% of dioctyl phthalate; and 0.5% of fumed silica.

250 g of a copolymer of methyl methacrylate and n-butyl methacrylate (the weight ratio of comonomers is 4:6), 200 g of ethyl acetate and 500 g of dimethylformamide were fed into a closed mixer, and stirred the mixed liquids for about 3 hours at a rate of 300 r/min until a transparent mixture was obtained. Then, 45 g of dioctyl phthalate and 5 g of fumed silica were added therein, and the mixture was further stirred for about 30 minutes until uniform, thereby obtaining an acrylic coating agent composition as an isolating layer.

Example 2

An Acrylic Coating Agent Composition as an Ink-Receiving Layer and Preparation Thereof In this example, the acrylic coating agent composition as an ink-receiving layer, based on the total weight of the composition, comprises: 7% of acrylic acid monomer, 14.5% of butyl acrylate monomer, 18.6% of vinyl ester modified dextrin, 6% of sorbitan monooleate, 1% of sodium pyrrolidone carboxylate, 0.5% of sulfosuccinate 4910, 0.5% of potassium persulfate, 0.001% of N-hydroxymethyl acrylamide, 0.15% of sodium sulfite, and distilled water balanced to 100%.

52.15 kg of distilled water and 18.6 Kg of vinyl ester modified dextrin were added in turn to an industrial reactor, and stirred them until uniform. Then, the temperature was raised to about 85° C., at which temperature the modified starch was fully dissolved and maturated. After cooling down to 35-40° C., 6 kg of sorbitan monooleate was added, and stirred the mixture for about 1 hour to make an emulsion. Thereafter, the temperature was raised to about 55° C., at this moment, 7 kg of acrylic acid monomer, 14.5 kg of butyl acrylate monomer, 1 kg of sodium pyrrolidone carboxylate and 500 g of sulfosuccinate 4910 were added, and stirred the mixture until uniform, and the system temperature was adjusted to 55-60° C. 500 g of potassium persulfate and 1 g of N-hydroxymethyl acrylamide were added, at this moment, the system temperature was automatically raised due to a graft copolymerization reaction, when the system temperature reached about 65° C., 150 g of sodium sulfite was added under stirring. Then, the flow rate of the resulting product was measured using a Zahn 3# cup, and when the flow rate was 55 seconds, the system was immediately cooled down with refluxing water, so that the graft-copolymerization reaction was terminated when cooling down to room temperature. The system was adjusted with ammonia to a pH of about 8.5, thereby obtaining an acrylic coating agent composition as an ink-receiving layer.

Example 3

Preparation of a Printing Type Cold Transfer Printing Paper

In the preparation of printing type cold transfer printing paper, the compositions prepared in Examples 1-2 were used. The acrylic coating agent composition as an isolating layer was coated on a base roll paper of 30 g/m$^2$ (the coating amount of the isolating layer was 5-6 g/m$^2$), then cured by heating in an oven at 35-45° C. for about 5 seconds, thereby obtaining an isolating layer. The acrylic coating agent composition as an ink-receiving layer was coated on the resulting isolating layer (the coating amount of the ink-receiving layer was 8-10 g/m$^2$), then cured by heating in an oven at 70-90° C. for about 5-8 seconds, thereby obtaining an ink-receiving layer; thus, a base paper having an isolating layer and an ink-receiving layer was prepared.

The above acrylic coating agent composition as an ink-receiving layer prepared in Example 2 was used for a printing paste, the latter comprises, by weight, 40% of the acrylic coating agent composition as an ink-receiving layer, 30% of dyes, 5% of palygorskite, 2% of PRINTOL S-c, a pH adjuster to adjust to be neutral, and distilled water balanced to 100%. The printing paste was prepared as follows: 30% of dyes, 5% of palygorskite, 2% of PRINTOL S-c and 23% of distilled water were mixed under stirring at a rate of 1,200 r/min for about 30 minutes, then 40% of the acrylic coating agent composition as an ink-receiving layer was added, followed by further stirring for about 1 hour and adjusting pH to be neutral, thereby obtaining the printing paste which was stored ready for use in a printing paste tank.

By a gravure printing machine (the printing dyes comprise three primitive colors comprising yellow, magenta and cyan, and black), using the printing paste as prepared above, a classical Disney pattern "Donald Duck and Mickey Mouse" was printed on the ink-receiving layer of the above base paper having the isolating layer and the ink-receiving layer, thereby obtaining a printing type cold transfer printing paper.

Example 4

Preparation of an Ink-Jet Type Cold Transfer Printing Paper

In this example, the used ink-jet printing paste comprises, by weight, 15% of the acrylic coating agent composition as an ink-receiving layer prepared in Example 2, 30% of reactive dyes, 2% of sodium pyrrolidone carboxylate as wetting agent, 2% of tributyl phosphate as surfactant and defoamer, and distilled water balanced to 100%. The ink-jet printing paste was prepared as follows: firstly, the dyes were dissolved with 30% of distilled water, to which the acrylic coating agent composition as an ink-receiving layer prepared in Example 2, then sodium pyrrolidone carboxylate as wetting agent, tributyl phosphate as surfactant and defoamer and the remaining distilled water were added. After mixing them under stirring for 1 hour, the mixture was treated with a homogenizer for 5 minutes, thereby obtaining the ink-jet printing paste. The printing paste had a fineness of below 20 micros as measured by an ink fineness meter, and had a flow rate within 15 seconds, which satisfied the production standards of ink-jet.

By a piezoelectric pulse ink-jet printer (the inkjet dyes comprises three primitive colors comprising yellow, magenta and cyan, and black), using the ink-jet printing paste as prepared above, a classical Disney pattern "Donald Duck and Mickey Mouse" was ink-jet printed on the ink-receiving layer of the base paper having the isolating layer and the ink-receiving layer prepared in Example 3, thereby obtaining an ink-jet type cold transfer printing paper.

Example 5

Application of the Printing Type and the Ink-Jet Type Cold Transfer Printing Papers on Different Fabrics According to conventional cold transfer procedures, the printing type and ink-jet type cold transfer printing papers prepared in Examples 3 and 4 were respectively used to transfer the patterns on the printing papers to cotton fabric (the fabric, which had been subjected to cooking and bleaching, was woven fabric free of fluorescent whitening agent, and had a weight of 150 g/m$^2$), and light-thin silk fabric (having a weight of 90 g/m$^2$).

The results showed that the style of the patterns transferred to the fabrics was identical to that of digital photographs, and the fineness thereof was better than any plate printing, in particular, the infiltration phenomenon appeared with conventional printing did not occur in the light-thin silk fabric. The transfer rate on both the cotton and light-thin silk fabrics was above 90%.

The invention claimed is:

1. A cold transfer printing paper, comprising a base paper and an isolating layer formed thereon and an ink-receiving layer formed on the isolating layer; said isolating layer and ink-receiving layer are obtained respectively by curing a first acrylic coating agent composition for forming the isolating layer, comprising, based on the total weight of the composition, 20-30% of an acrylic resin; 60-77% of a solvent; 2-8% of a toughening agent; and 0.2-2% of a filler on said base paper and a second acrylic coating agent composition for forming the ink receiving layer, comprising 15-30% of an acrylic monomer; 15-23% of a modified starch; 5-8% of an emulsifier; 0.5-1.2% of a wetting agent; 0.3-0.6% of a non-emulsifying surfactant; 0.4-0.9% of an initiator; 0.001-0.01% of a crosslinking agent; 0.12-0.15% of a terminator, and water balanced to 100% on said isolating layer.

2. The cold transfer printing paper according to claim 1, wherein the acrylic resin includes polymers of C1-C10 alkyl (meth)acrylate.

3. The cold transfer printing paper according to claim 1, wherein the acrylic resin is a copolymer of methyl methacrylate and n-butyl methacrylate having a weight ratio of the comonomers of from 5:5 to 4:6; the solvent is a mixture of ethyl acetate and dimethylformamide in a weight ratio of from 2:8 to 5:5; the toughening agent is dioctyl phthalate; and the filler is fumed silica.

4. The cold transfer printing paper according to claim 3, wherein the acrylic coating agent composition or forming the isolating layer, based on the total weight of the composition, comprises: 25% of a copolymer of methyl methacrylate and n-butyl methacrylate having a weight ratio of the comonomers of 4:6; 20% of ethyl acetate and 50% of dimethylformamide; 4.5% of dioctyl phthalate; and 0.5% of fumed silica.

5. The cold transfer printing paper according to claim 1, wherein the acrylic monomer includes acrylic acid and C1-C4 alkyl acrylates; the modified starch is vinyl ester modified starch; the emulsifier is sorbitan monooleate; the wetting agent is sodium pyrrolidone carboxylate; the non-emulsifying surfactant is sulfosuccinate 4910; the initiator is potassium persulfate; the crosslinking agent is N-hydroxymethyl acrylamide; and the terminator is sodium sulfite.

6. The cold transfer printing paper according to claim 1, wherein the acrylic monomer is a mixture of acrylic acid and butyl acrylate in a weight ratio of from 1:1 to 1:2.5.

7. The cold transfer printing paper according to claim 1, wherein the acrylic coating agent composition for forming the ink-receiving layer, based on the total weight of the composition, comprises: 7% of acrylic acid monomer and 14.5% of butyl acrylate monomer; 18.6% of vinyl ester modified dextrin; 6% of sorbitan monooleate; 1% of sodium pyrrolidone carboxylate; 0.5% of sulfosuccinate 4910; 0.5% of potassium persulfate; 0.001% of N-hydroxymethyl acrylamide; 0.15% of sodium sulfite; and distilled water balanced to 100%.

8. A method for printing a pattern or letter on a fabric, comprising forming an inked image on the cold transfer printing paper according to claim 1 and transferring the inked image to a fabric.

9. The method according to claim 8, wherein the fabric is selected from the group consisting of fabrics made of natural fibers, fabrics made of protein fibers, and fabrics made of chemical fibers.

10. The method according to claim 9, wherein the fabric comprises natural fibers which are selected from the group consisting of modified cellulose fibers and cotton.

11. The method according to claim 9, wherein the fabric comprises protein fibers selected from the group consisting of wool and silk.

12. The method according to claim 9, wherein the fabric comprises chemical fibers selected from the group consisting of terylene, nylon, and acrylic fiber.

13. A method for preparing a connecting material for cold transfer printing paper having a connecting material comprising an isolating layer and an ink receiving layer thereon comprising:

preparing a first acrylic coating agent composition for forming an isolating layer by providing an acrylic resin and a solvent and mixing them to obtain a transparent mixture, and adding a toughening agent and a filler to said mixture and mixing together until uniform, thereby obtaining the first acrylic coating agent composition for forming the isolating layer; coating and curing the first acrylic coating agent composition onto a surface of a base paper to form the isolating layer;

preparing a second acrylic coating agent composition for forming an ink-receiving layer by providing water and a modified starch, and allowing the modified starch to dissolve and maturate under heating and stirring conditions, adding an emulsifier to the obtained mixture at a temperature of 35-40° C., to make an emulsion, at a temperature of 50-60° C., adding to said emulsion an acrylic monomer, a wetting agent and a non-emulsifying surfactant in turn, followed by mixing them under stirring until uniform, adding an initiator and a crosslinking agent at a temperature of 55-60° C. to initiate graft copolymerization reaction, adding a copolymerization terminator under stirring when the system temperature reaches 65-70° C., and according to GB/T1723-93 method, measuring viscosity of the resulting product using a Zahn 3# cup, when the flow rate is 50-58 seconds, immediately cooling down the system to room temperature with refluxing water, thereby obtaining the second acrylic coating agent composition for forming the ink-receiving layer; and coating and curing the second acrylic coating agent composition onto the isolating layer to form the ink receiving layer.

14. The method according to claim 13, wherein the step of providing water and modified starch is carried out by feeding water and modified starch to an industrial reactor, stirring them until uniform, then raising the temperature to 65-90° C. and maintaining this temperature until the modified starch is fully dissolved and maturated; and, after adding an emulsifier, further stirring for 50-90 minutes to make an emulsion.

15. The method according to claim 13, further comprising adjusting the pH of the resulting product to pH=7-9.

* * * * *